US006717528B1

(12) United States Patent
Burleson et al.

(10) Patent No.: US 6,717,528 B1
(45) Date of Patent: Apr. 6, 2004

(54) SYSTEM AND METHOD FOR DYNAMIC FEEDBACK PROJECTION FROM A HAND-HELD POINTING DEVICE

(75) Inventors: Winslow Scott Burleson, Cambridge, MA (US); David Lu, San Jose, CA (US); John Martin Mullaly, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/506,238

(22) Filed: Feb. 17, 2000

(51) Int. Cl.[7] ..... G08C 19/00

(52) U.S. Cl. ..... 340/825.72; 340/825.69; 340/825.52; 340/825.56; 340/5.61; 340/5.64; 345/158; 345/169; 345/170; 348/734

(58) Field of Search ..... 340/825.17, 825.69, 340/825.72, 825.52, 825.56, 5.61; 353/31, 122; 345/169, 173, 158; 348/734

(56) References Cited

U.S. PATENT DOCUMENTS 4,746,919 A 5/1988 Reitmeier ..... 340/825.56
5,646,608 A * 7/1997 Shintani ..... 340/825.52
6,127,941 A * 10/2000 Van Ryzin ..... 340/825.69

* cited by examiner

*Primary Examiner*—Michael Horabik
*Assistant Examiner*—Yves Dalencourt
(74) *Attorney, Agent, or Firm*—Duke W. Yee; Volel Emile; Wayne P. Bailey

(57) ABSTRACT

A system and method for providing dynamic feedback projection from a hand held pointing device is provided. The system includes a hand held pointing device that is capable of two way communication with appliance interfaces associated with appliances that are controllable by the hand held pointing device. The hand held pointer is capable of transmitting signals to the appliance interfaces and receiving response signals from the appliance interfaces. The hand held pointing device further includes a visible light projection apparatus for projecting light onto a remote surface. The projected light is displaced on the remote surface by a light projection modification apparatus such that the projected light creates images corresponding to the response signals from the appliance interfaces.

56 Claims, 4 Drawing Sheets

SYSTEM AND METHOD FOR DYNAMIC FEEDBACK PROJECTION FROM A HAND-HELD POINTING DEVICE

BACKGROUND OF THE INVENTION

This application is related to co-pending and commonly assigned U.S. patent application Ser. Nos. 09/343,440 filed Jun. 30, 1999, and 09/343,442 filed Jun. 30, 1999, and commonly assigned U.S. patent application Ser. No. 09/210,504 filed Dec. 11, 1998 (now abandoned), which are hereby incorporated by reference in their entirety.

TECHNICAL FIELD

The present invention is directed to a system and method for dynamic feedback projection from a hand-held pointing device.

DESCRIPTION OF RELATED ART

Remote control communications systems are often employed to allow control of certain electronic targets from a distance. Such targets may include electronically controlled appliances. Exemplary forms of such appliances include any type of home-based appliance, as well as appliances that are found outside the home such as, for example, automotive controls, industrial controls, or security locks.

Although conventional remote control systems provide convenience over non-remote operation, these systems do have some limitations. One such limitation is that multiple handheld remote control units may be required to control multiple targets (or appliances). Although "universal" remote control units are available which can control multiple appliances, such units typically work for a limited number of appliances, and the remote control unit must be programmed with information about each appliance.

With universal remote controls, the particular appliance to be controlled is selected, typically by pushing a button or key dedicated to that appliance. This may result in a hand-held unit having a large number of buttons, which may make the unit more complex or cumbersome to operate so that mistakes are more likely.

Another limitation of conventional remote control communications systems is that remote control is routinely available for only a relatively small variety of appliances. Consumer electronic appliances, for example, are routinely provided with remote control units, but remote control may not be readily available for other types of appliances, such as, e.g., kitchen appliances, lighting, and climate control. Furthermore, conventional remote control communications systems generally rely on optical transmission, so that a clear line of sight between the remote control unit and the appliance is required.

It may be desirable, however, to control appliances situated such that a clear line of sight does not exist. For example, control of a stereo or a thermostat from another room may be convenient without having to optically target the appliance to be controlled.

One approach to providing such non-line-of-sight control is to use radio-frequency (RF) transmission in addition to or instead of optical transmission. The RF range is quite broad, extending from approximately 10 kHz ($10^4$ Hz) to about 300 GHz ($3\times10^{11}$ Hz), and is used for various types of communications. For example, wireless voice and data communications typically use frequencies in a range from about 800 MHz to a few GHz. The lower frequencies associated with RF communications, as compared to communication at infrared and visible optical frequencies (from about $10^{13}$ to $10^{15}$ Hz), allow transmission over larger distances, and diffraction around or transmission through certain obstacles.

Remote control communications systems have been developed which employ RF transmission. Some systems may use solely RF transmission, while others, such as that described in U.S. Pat. No. 5,227,780 to Tigwell, allow RF transmission from a remote control unit to a transponder located in the vicinity of the appliance to be controlled. The transponder then transmits an infrared control signal to the appropriate appliance. Other systems, such as that described in U.S. Pat. No. 4,904,993 to Sato, allow either RF or optical transmission to be chosen, based on the nature of the path between the remote control unit and the appliance to be controlled, and some, such as that described in U.S. Pat. No. 5,659,883 to Walker et al., transmit RF and optical signals simultaneously, allowing the appliance receiver to extract the highest-quality signal.

A disadvantage of using RF transmission is that the ensuing increased transmission range may inadvertently cause communication with multiple appliances simultaneously, when communication with only one appliance may be desired. For this reason, currently available remote control communications systems which use RF transmission must typically be configured so that only a specific receiving appliance will respond to a signal from a remote control unit. Identification of the specific receiving appliance is generally accomplished by transmission of an identifying code from the remote control unit to the receiver associated with the appliance, as described, for example, in U.S. Pat. No. 5,500,691 to Martin et al. The requirement for such an identifying code unfortunately may limit the number of appliances which can be conveniently controlled by a single remote control unit. For example, if codes corresponding to various appliances are stored in the remote control unit, and the particular appliance to be controlled is chosen by pressing a corresponding button on the control unit, space constraints on the remote control unit may allow for only a limited number of appliances to be addressed.

It would, therefore, be advantageous to have a remote control communications system and method in which a single handheld remote control unit may be used to communicate with a wide variety of appliances. It would further be advantageous to have an apparatus and method for controlling a plurality of appliances and to receive feedback from the appliances to thereby determine various operating modes of the appliances.

SUMMARY OF THE INVENTION

The present invention provides a system and method for providing dynamic feedback projection from a hand held pointing device. The system includes a hand held pointing device that is capable of two way communication with appliance interfaces associated with appliances that are controllable by the hand held pointing device. The hand held pointer is capable of transmitting signals to the appliance interfaces and receiving response signals from the appliance interfaces. The signals sent to the appliance interfaces and received from the appliance interfaces may be optical signals, radio frequency (RF) signals, infrared signals, and the like.

Additionally, the hand held pointing device includes a visible light projection apparatus for projecting light onto a remote surface. The projected light is displaced on the remote surface by a light projection modification apparatus such that the projected light creates images corresponding to the response signals from the appliance interfaces.

The light projection modification apparatus may include a reflective surface and devices for altering the angle of the reflective surface so that the position of the projected light on a remote surface is altered. In one embodiment, the reflective surface may be a mirror and the devices for altering the angle of the mirror may be struts associated with an X axis speaker and a Y axis speaker. The speakers convert electrical signals into mechanical perturbations which cause the struts to displace, thereby displacing the mirror.

The angle of the reflective surface is modified based on control signals from a microprocessor in the hand held pointing device. The microprocessor may make use of information stored in a memory for determining the shapes which the projected light is to make on the remote surface. The shapes may be predetermined or may be generated using graphical primitives stored in the memory.

A user may cycle through the images that are projected onto the remote surface by operating an actuator on the hand held pointing device. Once the user finds an image corresponding to a desired function that is to be performed by the appliance, the user may select the function by operating another actuator on the hand held pointing device. In response, the image projected onto the remote surface may be changed to indicate the performance of the desired function. In this way, the appliance is able to provide visual feedback to the user so that the user may readily determine the available functions associated with an appliance and also determine an appliance's current state with regard to these functions.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein like numerals designate like elements, and wherein:

DETAILED DESCRIPTION OF THE PREFERRED EMBODIMENT

Figure 1:
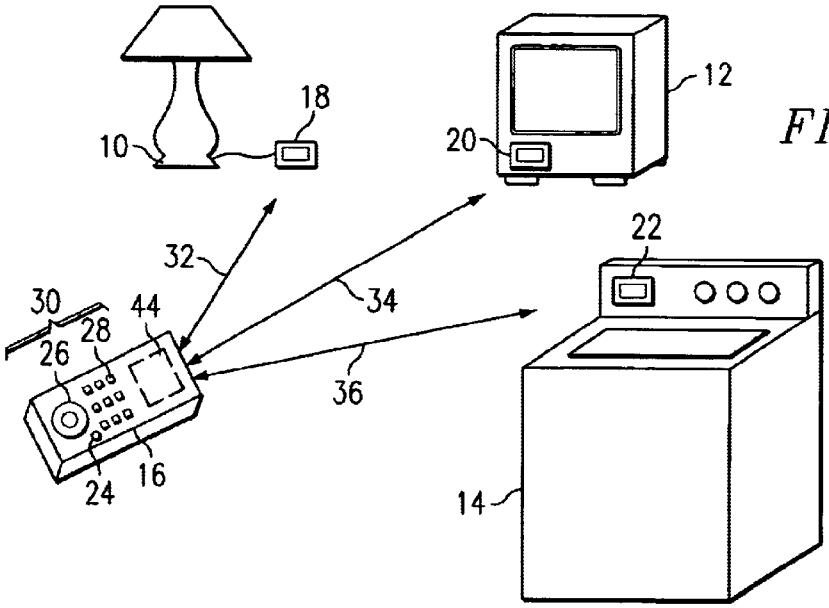
FIG. 1 is an exemplary diagram illustrating the use of a hand held pointing device to communicate with a plurality of appliances.

FIG. 1 illustrates the concept of communication with addressable targets or appliances using a generalized pointing device, or pointer. "Addressable" as used herein indicates that an appliance may be specifically selected to receive a signal intended for that particular appliance alone, though the signal may be transmitted in such a way that it is available to reception circuitry of other appliances. For example, the signal may be broadcast in all directions using an RF signal, but acted upon by only one of the appliances in its path, the appliance for which the RF signal is decoded and therefore intended. Mechanisms by which an appliance is specifically addressed may include, for example, transmission of a directed optical selection signal along a line-of-sight path between a pointing device and the appliance, transmission of a code (e.g., address) recognized by only the intended appliance as part of the signal, or the like.

In the embodiment of FIG. 1, the system including pointing device 16 and one or more of appliance interfaces 18, 20 and 22 allows remote communication with one or more of the corresponding addressable appliances 10, 12, and 14. Each of the appliance interfaces 18-22 is configured specifically for its corresponding appliance, and is operably coupled to this appliance. "Operably coupled" as used herein indicates a coupling in such a way that allows operation of the combination.

Appliance interface 18, for example, is coupled to appliance 10, a lamp, such that data including, for example, instructions and control signals may pass between them. The coupling may therefore be in the form of, e.g., wire, cable, metallization line, wireless transmission medium, and the like.

The appliance interface 18–22 may be packaged in a separate unit from the appliance 10–14, such as interface 18 and appliance 10, or it may be configured upon or within the appliance, such as with interfaces 20–22 and appliances 12–14, respectively. In an alternative embodiment, a single appliance interface may be operably coupled to more than one appliance. In such an embodiment, the pointing device may indicate which appliance is to be addressed through the interface by sending, for example, an identifying code, identifying frequency or wavelength signal, or the like, identifying the appliance to be addressed.

The appliances of FIG. 1 are addressable by pointing device 16 using their respective appliance interfaces 18–22. An appliance interface 18–22 may be combined with an appliance 10–14 as part of a retrofit of the appliance 10–14 to make it pointer-compatible, or may be included in the manufacture of a pointer-compatible appliance.

Although household appliances are shown in FIG. 1, an appliance may be any electronically controllable device. For example, the appliance may be a personal computer, digital alarm clock, telephone answering machine, an automatic door, an elevator, or the like.

The pointing device 16, also referred to herein as pointer 16, includes one or more actuators 30. The actuators 30 may be, for example, a button 24, a trackball 26, a key 28, or the like. Actuators 30 may include any actuator operable by a user, such as a button, knob, key, trackball, touchscreen, joystick or scroll wheel. In one embodiment, the pointer 16 may be configured to accept voice commands instead of or in addition to actuator operations.

The pointer 16 and appliance interfaces 18, 20 and 22 are configured for two-way communication between the pointer and the interface, as will be described hereafter. In some embodiments, the pointer 16 may include a display device, such as display screen 44. Solid arrows 32, 34, and 36 represent transmission of signals from pointer 16 to appliance interfaces 18, 20, and 22, and vice versa, respectively.

The pointing device 16 is preferably a compact unit for handheld operation, suitable for being conveniently carried by a user. Because pointer-compatible appliances may be located both inside and outside of a home or office, use of the pointing device as a "personal" pointer is contemplated. In preferred embodiments, a user may use such a personal pointer to operate appliances encountered in multiple places to which the user may go, such as homes, offices, and public places.

Appliances 10–14 for which limited access is desired may have appliance interfaces 18–22 configured to allow the appliance interface 18–22 to be selected by only particular pointing devices 16. For example, the pointer 16 may transmit a pointer-specific identification code which may be used by the appliance interface 18–22 to determine if the user is an authorized user of the appliance 10–14.

When the appliance interfaces 18–22 receive a signal from the hand-held pointing device 16, the appliance interfaces 18–22 respond with a signal identifying the type of appliance to which the appliance interface 18–22 is coupled. The identification may be merely an identifier of the type of device or may be more elaborate and include information pertaining to the make, model, serial number, and the like, of the particular appliance.

In addition, the signal may include identifiers of the capabilities of the particular appliance. Thus, for example, if the pointing device 16 sends a signal to the appliance interface 18, the pointing device 16 may receive a response signal from the appliance interface 18 indicating that it is coupled to a lamp, that the lamp is of the type that has three brightness settings, and that the lamp may be turned on, turned off, or have the brightness setting increased or decreased.

The pointing device 16 may be preprogrammed for various appliances 10–14 such that the pointing device 16 stores in a memory a listing of appliances and the various functions that may be performed with each appliance. Thus, the pointing device 16 may receive a response signal from an appliance interface 18–22 indicating the type of appliance to which it is coupled, and the pointing device 16 may then look-up in the memory the functions that may be performed using that appliance.

Alternatively, the memory in the pointing device 16 may be empty with regard to appliances with which the pointing device 16 is to communicate. The listing of appliances may be "built-up" as the pointing device 16 receives signals from various appliances. Thus, for example, if the pointing device 16 is directed at the lamp 10 and receives a response signal from the appliance interface 18 indicating the lamp 10 identity, type, and available functions, this information may be stored in the memory of the pointing device 16 for later use. When the pointing device 16 is then directed at the washing machine 14, information in the response signal from appliance interface 22 may then be stored in the memory of the pointing device 16 for later use when operating the washing machine 14. In this way, a listing of appliances may be "built-up" in the pointing device 16.

In an alternative embodiment, the information for controlling the appliances may be stored in a temporary storage in the pointing device 16. Thus, when the lamp 10 returns a response signal to the pointing device 16, this information may be stored in a temporary storage for use in controlling the lamp 10. When the pointing device 16 is directed at another appliance, such as washing machine 14, the information in the temporary storage is overwritten by information in the response signal from the other appliance. Thus, the amount of memory needed to store information for controlling a plurality of appliances is minimized. This reduces the complexity and overall cost of the pointing device 16.

Furthermore, with the present invention, indicators of the various functions that may be performed, and the functions selected by a user of the pointing device 16, may be projected by the pointing device 16 using information retrieved from the memory, as will be described more fully hereafter. In this way, the user of the pointing device 16 will be provided visual indicators of available functions and selected functions for use in determining how to operate the various appliances 18–22.

2 WAY COMMUNICATION

Figure 2:
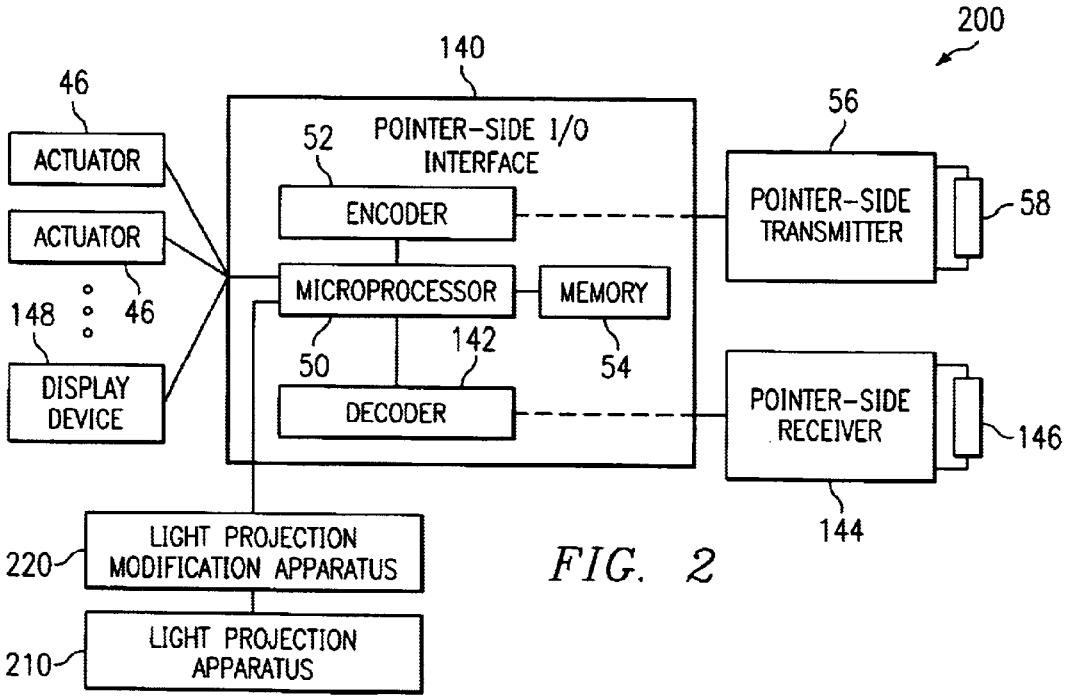
FIG. 2 is an exemplary block diagram of a hand held pointing device according to the present invention.

FIG. 2 is a block diagram of a pointing device 200 according to the present invention. The pointing device 200 includes one or more actuators 46, a pointer-side input/output (I/O) interface 140, a pointer-side transmitter 56, a pointer-side receiver 144, a transmitting element 58 and a receiving element 146. The pointer-side I/O interface 140 further includes a microprocessor 50, memory 54, encoder 52 and decoder 142.

Actuators 46 represent actuators such as actuators 30 in FIG. 1. Operation of actuators 46 generates pointer commands, or pointer events, which are forwarded to the pointer-side I/O interface 140.

The pointer-side I/O interface 140 includes a microprocessor 50, encoder 52, memory 54 and decoder 142. Encoder 52, as controlled by microprocessor 50, generates a unique pointer event signal for each pointer event forwarded by actuators 46. The pointer event signal is forwarded to pointer-side transmitter 56 for transmission to an appliance interface 18–22. This encoding of the pointer event into a signal may include, for example, a conversion of a parallel signal into a signal suitable for serial transmission.

Memory 54 may be accessed by microprocessor 50 in order to represent the incoming pointer events as pointer event signals. Memory 54 may include, for example, data providing a correspondence between the signals forwarded by the actuators 46 and the pointer event signals to be forwarded to the pointer-side transmitter 56. Memory 54 may also include a buffer section for temporary storage of pointer event data used by the microprocessor 50 or the encoder 52, and/or identification code information for the pointer, for use in embodiments in which a pointer identification code is included in transmitted signals.

The pointer event signal is forwarded to pointer-side transmitter 56, which includes transmitting element 58. Transmitting element 58 may be an optical transmitting element, such as a laser diode or light-emitting diode, an antenna for RF transmission, an ultrasonic transmission device, or the like.

The I/O interface 140 of FIG. 2 also accepts appliance response information received by pointer-side receiver 144. The decoder 142 processes signals received from an appliance interface 18–22 and decodes them to identify the information encoded in the received signal.

Information received from the appliance interface 18–22 may be stored in memory 54 as described above and may be made available to the user of the pointing device using display device 148, however, display device 148 is an optional component as will be discussed hereafter. In some embodiments, display device 148 could be as simple as a light which illuminates or blinks in response to signals from the appliance interface. In other embodiments, the display device 148 may be a display screen, such as a liquid crystal display (LCD) screen, upon which appliance-specific information, such as available control options or appliance functions may be displayed.

Additionally, the appliance-specific information may be displayed to the user by way of projecting the appliance-specific information, or indicators of the appliance-specific information, from the pointing device 200 onto the environment in which the pointing device 200 is being used, such as on a remote surface. In order to project the appliance-specific information onto the environment, the pointing device 200 includes a projection apparatus 210 to project light and a light modification apparatus 220 to modify the way in which the light is projected.

The microprocessor 50 may be utilized for determining how the projected light is to be modified. The projected light from the projection apparatus 210 may be, for example, a laser or other visible light that may be manipulated to create images on a remote surface. The light modification apparatus 220 for modifying the way in which the laser is projected may be any type of device that is capable of modifying the projection of light, such as by deflecting the projection of laser light, in such a manner as to create images on a remote surface.

Figure 3:
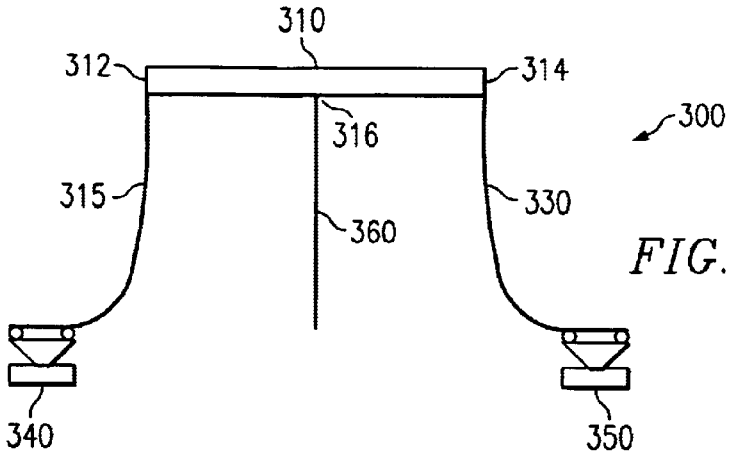
FIG. 3 is an exemplary diagram of a light projection modification apparatus for use with the hand held pointing device of FIG. 2.

FIG. 3 is an exemplary diagram illustrating an exemplary laser deflection apparatus 300 for modifying the way in which laser light from a laser pointer may be manipulated to project images. As shown in FIG. 3, the laser deflection apparatus 300 includes a reflective surface 310, such as a mirror, connected to three struts, an X-axis strut 315, a Y-axis strut 330 and a fixed strut 360, by way of flexible cement joints 312, 314 and 316. The X-axis and Y-axis struts 315 and 330 are further coupled to an X-axis speaker 340 and a Y-axis speaker 350, respectively.

The reflective surface 310 may be, for example, triangular in shape, being supported at three corners by the X-axis strut 315, the Y-axis strut 330, and the fixed strut 360. The reflective surface 310 may be cut from a sheet of material that is only a few millimeters thick to thereby allow faster deflection and minimize weight. In some embodiments, the reflective surface 310 may make use of honeycombed hollows on the back side of the reflective surface.

The triangular shape of the reflective surface 310 is preferably a right triangle (having interior angles of 45, 90 and 45 degrees). The right triangle shape helps to reduce interaction between the X-axis and Y-axis deflections. However, the invention is not limited to the use of a right triangle and other triangular shapes may be utilized without departing from the spirit and scope of the invention.

The fixed strut 360 remains fixed at all times relative to the reflective surface 310. The X-axis strut 315 and Y-axis strut 330 are displaced by the speakers 340 and 350 to thereby modify the angle of the reflective surface 310. The displacement of the reflective surface 310 has the effect of displacing light reflected from the reflective surface 310. The reflected light can thus, be moved in two dimensions, X and Y, corresponding to the displacement of the X and Y axis struts 315 and 330. By moving a laser beam very quickly over a remote surface, using the laser deflection apparatus 300, various images can be drawn on the surface.

The X and Y axis struts 315 and 330 are displaced by a set of audio speakers, X-axis speaker 340 and Y-axis speaker 350, which are used to effect movement in the X and Y axis struts 315 and 330 with a predetermined pattern of vibration from the speakers 340 and 350. However, the invention is not limited to the use of speakers 340 and 350 for displacing the struts 315 and 330. Rather, any type of device that is capable of displacing the struts 315 and 330 such that images may be formed by light reflected from the mirror 310, may be used without departing from the spirit and scope of the present invention.

Figure 8:
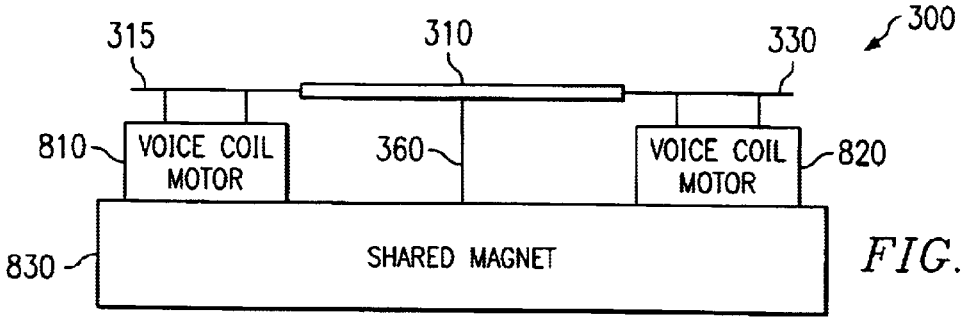
FIG. 8 is an exemplary diagram of a light projection modification apparatus according to another embodiment of the present invention.

For example, as shown in FIG. 8, voice coil motors 810 and 820 along with a shared magnet 830 may be used in place of the audio speakers 340 and 350. The voice coil motors 810 and 820 convert electrical current into linear mechanical motion. An example of a voice coil motor 810 or 820 is the transducer that is available in currently available earbud headphones for portable compact disc players. Another example of a voice coil motor 810 or 820 is a laser focusing lens mechanism in many compact disc players.

The size of the components shown in FIGS. 3 and 8 is such that they may be housed in a hand-held pointing device. For example, the width from one strut 315 to the other strut 330 may be from approximately 10 mm to a width that is equal to or less than the width of the laser beam of the hand-held pointing device. For example, a micromirror array, such as that developed by Texas Instruments and described at the DLP technology portion of their web site [www.ti.com/dlp/technolony], may be used to decrease the size of the laser deflection apparatus 300.

In addition, other modifications may be made to the apparatus illustrated in FIGS. 3 and 8 without departing from the spirit and scope of the invention. For example, the reflective surface may be replaced by a refractor, such as a prism, or a waveguide. The preferred embodiment of the present invention is the embodiment illustrated by FIG. 8 in which the struts 315, 330 and 360 are of minimal length with a maximal stiffness to mitigate resonances and having a reflective surface whose length, i.e. the distance between struts 315 and 330, is approximately 5 mm. The overall size of the laser deflection apparatus 300 in the preferred embodiment is approximately 5 cubic centimeters.

Returning to the laser deflection apparatus 300 shown in FIG. 3, the operation of the laser deflection apparatus 300 will now be described. It should be noted that similar functionality is obtained from the laser deflection apparatus 300 shown in FIG. 8.

The microprocessor 50 is used to determine and control the patterns of displacement of the X and Y axis struts 315 and 330. Based on certain conditions, such as a response signal received from an appliance interface 18–22, the microprocessor 50 may instruct the X and Y speakers 340 and 350 to generate vibrations to displace the struts 315 and 330 in such a manner that the laser light reflected from the reflective surface 310 generates an image on a remote surface. The particular patterns generated may be predetermined patterns stored in memory 54 or may be generated from graphics primitives (e.g. lines, circles, squares) stored in memory 54.

Alternatively, the projected images may be generated based on instructions sent from the appliance. For example, if the appliance is a sophisticated robotic device having an image sensor and an image processing system, the robot may respond to the hand-held pointing device by sending information related to the outlines of objects that are in the visual field of the image sensor. In this way, a user may cycle through images projected by the hand-held pointing device corresponding to the objects within the visual field of the robotic device. A user may then select an object by selecting a projected image, and thereby instruct the robotic device to perform a function on the object. Thus, rather than having predetermined image shapes in memory, the hand-held pointing device may process image projection instructions received from the appliance directly.

Thus, with the present invention, the user of the pointing device 200 may orient the pointing device 200 such that a signal from the pointing device 200 is received by an appliance interface 18–22. Alternatively, if the pointing device 200 makes use of RF transmission, the pointing device 200 need not be oriented toward the appliance interface 18–22.

The user may then send a signal to the appliance interface 18–22 by activating an actuator 46. The command from the actuator 46 is translated by the microprocessor 50 and encoder 52 into a signal that is transmitted to the appliance interface 18–22 by way of the pointer-side transmitter 56 and transmitting element 58.

Alternatively, the pointing device 200 may automatically send a signal to the appliance interface 18–22 by either constantly or periodically sending a signal that may be received by an appliance interface 18–22. When the signal is directed at a particular appliance interface 18–22, the appliance interface may respond accordingly.

When the signal is received by the appliance interface 18, for example, the appliance interface sends a response signal back to the pointing device 200 which receives the response signal via the receiver element 146 and the pointer-side receiver 144. The response signal is decoded using the decoder 142 and the encoded information in the response signal is processed by the microprocessor 50.

The information in the signal received from the appliance interface 18–22 may be stored in memory 54 for later use by the pointing device 200 in controlling the various appliances 10, 12, and 14. The storage of this information may be used to "build-up" a list of appliances with which the pointing device 200 may communicate or may be a temporary storage of information, as described above.

Based on the information in the response signal received, the microprocessor 50 retrieves image information from the memory 54. Additionally, the microprocessor 50 may retrieve information for display on the optional display device 148. The image information and display information may be appliance specific.

The microprocessor 50 then sends control signals to the light projection modification apparatus 220 instructing the light projection modification apparatus 220 to modify the projection of light from the light projection apparatus 210 such that one or more appropriate images are projected onto a remote surface.

In one embodiment of the present invention, the user may cycle through available images and hence, available appliance functions by operating one or more actuators 46. Thus, for example, the user may press a button on the pointing device 200 and the microprocessor 50 may send a control signal to the light projection modification apparatus 220 to modify the light projected from the light projection apparatus 210. In this way, a second image, different from a first image, is projected onto a remote surface.

When the user wishes to perform an appliance function identified by the projected image, the user may operate an actuator 46 to thereby select the appliance function. In response, the microprocessor 50 sends a command signal to the encoder 52 to encode a signal for instructing the appliance to perform the desired appliance function. The signal is then transmitted to the appliance via the pointer-side transmitter 56 and the transmission element 58.

The two-way communication between the appliance interface 18 and the pointing device 200 may continue as functions are performed, selected, canceled, initiated, and the like. With each communication between the appliance interface 18 and the pointing device 200, the images that are projected may be modified to indicate new functions available or to eliminate functions that are no longer valid. For example, if the brightness of the lamp 10 is increase to its upper limit, the function for increasing the brightness of the light may be removed as an available appliance function. Similarly, if the washing machine 14 is instructed to set a washing time to 30 minutes, a newly available appliance function of "start wash" may be provided and a corresponding image may be projected.

Figure 4:
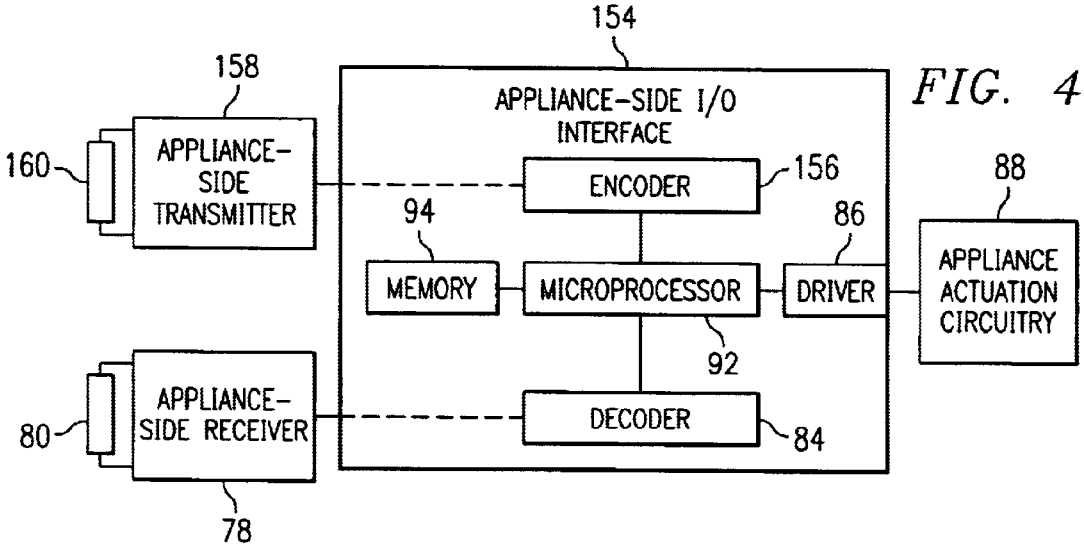
FIG. 4 is an exemplary block diagram of an appliance interface.

FIG. 4 is an exemplary diagram of the appliance interface 18 according to the present invention. As shown in FIG. 4, the appliance interface 18 includes a transmission element 160, an appliance-side transmitter 158, a receiver element 80, an appliance-side receiver 78, an appliance-side I/O interface 154 and appliance actuation circuitry 88. The appliance-side I/O interface 154 further includes a microprocessor 92 coupled to an encoder 156, a decoder 84, a memory 94 and a driver 86.

Signals from the pointing device 200 are received by the appliance interface 18 via the receiver element 80 and the appliance-side receiver. Similar to the transmission element and the receiving element of the pointing device 200, the transmission element 160 and the receiver element 80 may be, for example, either an optical receiver, an RF receiver, a combination of optical and RF receivers, or the like.

The received signal is then decoded by the decoder 84 and the information contained in the signal is processed by the microprocessor 92. If the signal is a command signal for instructing the appliance to perform a desired function, the microprocessor 92 instructs the driver 86 to send a driver signal to the appliance actuation circuitry 88 to cause the appliance to perform the desired function. If the signal is not a command signal but rather a signal requesting the appliance interface 18 to respond, the microprocessor 92 instructs the encoder 156 to send a response signal via the appliance-side transmitter 158 and the transmission element 160. The memory 94 stores appliance specific information for use by the microprocessor 92 in communicating with the pointing device 200 and for instructing the driver 86 to drive the appliance actuation circuitry 88.

The above description of the invention is made with reference to the pointing device 200 communicating with an appliance to perform functions on a single appliance. The invention is not limited to such an embodiment. The invention may also be implemented such that functions may be shared among a plurality of appliances.

Figure 5:
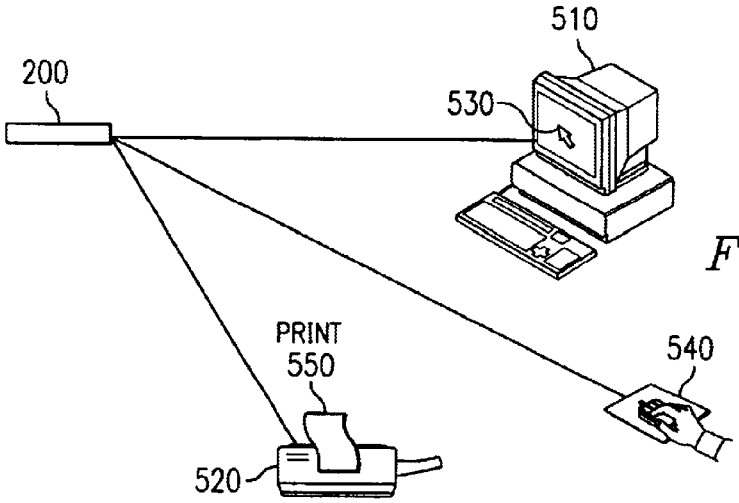
FIG. 5 is an exemplary diagram illustrating the change in projected images as the hand held pointing device is repositioned from one appliance to another.

FIG. 5 is an exemplary diagram illustrating a pointing device 200 being used to cause a printer 520 to print a document stored on the computer 510. Both the computer 510 and the printer 520 include an appliance interface such as the appliance interface 18.

As shown in FIG. 5, when the pointing device 200 is oriented toward the computer 510, or when the pointing device 200 transmits a signal that is specifically directed to the computer 510, the computer 510 sends a response signal indicating the type of device. The pointing device 200 then causes an image of an arrow 530 to be projected onto the computer 510. By operating actuators 46 on the pointing device 200, the pointing device 200 may instruct the computer to perform various functions. The various functions may be identified by various images projected by the pointing device 200. The arrow 530, for example, may represent a selection function. The user may thus, select a file on the computer 510, such as an open document or a currently active document, by projecting the image of the arrow 530 on the computer 510 and operating an actuator 46.

By selecting the open or active document on the computer 510, the computer 510 sends a response signal to the pointing device 200 indicating the document that was selected. The pointing device 200 may then be re-oriented such that the pointing device 200 is directed at a printer 520. In the process of re-orienting the pointing device 200, the image that is projected may be changed to an image indicating that a document has been selected, such as the "hand grasping a page" image 540.

When the pointing device 200 is directed towards the printer 520, the projected image may be changed to project a "print document" image 550. In response to a user operating an actuator 46 on the pointing device 200, the printer 520 may send a response signal to the pointing device 520 indicating an identifier, such as a network address, of the printer 520. The pointing device 200 may then send a signal to the computer 510, such as by way of an RF signal, instructing the computer 510 to print the selected document using the printer 520. Alternatively, the user may re-orient the pointing device 200 so that it is directed back at the computer 510 and then the user may operate an actuator 46 to initiate the printing of the selected document.

If, for example, the printer 520 were unable to perform its print function with the computer 510 or with the particular selected document, when the pointing device 200 is re-oriented so that it is directed at the printer 520, a null symbol may be projected by the pointing device 200 under instruction from the printer 520. Thus, for example, when the pointing device 200 sends a signal to the printer 520 indicating that the selected document on computer 510 is to be printed, the appliance interface associated with the printer 520 may determine whether the desired function may be performed. If not, the appliance interface may send a response signal indicating that the pointing device 200 is to project a null symbol and does not provide the printer identifier to the pointing device 200.

Figure 6:
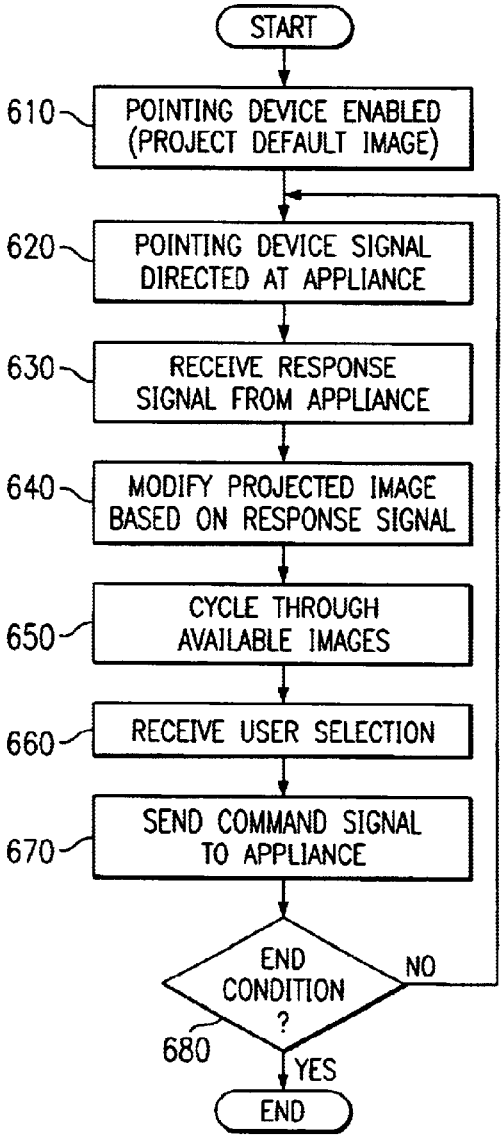
FIG. 6 is a flowchart outlining an exemplary operation of the hand held pointing device.

FIG. 6 is a flowchart outlining an exemplary operation of the pointing device 200 when communicating with a single appliance. As shown in FIG. 6, the operation starts with the user enabling the pointing device 200 (step 610). When the pointing device 200 is enabled, a default image projection, such as an arrow image, may be projected so that the user is able to track where the pointing device 200 is being directed.

Then, the user directs the pointing device towards an appliance thereby projecting the default image onto the appliance and directing a signal to the appliance (step 620). The appliance sends a response signal to the pointing device 200 indicating the type of appliance and/or the available appliance functions that may be performed (step 630). This information may be stored in memory 54, as described above.

In response to receiving the response signal from the appliance, the pointing device 200 may modify the projected image to project one or more images corresponding to available appliance functions (step 640). The user may cycle through the one or more images by operating an actuator 46 on the pointing device 200 (step 650).

When an image corresponding to a desired appliance function is projected, the user may select the desired function by operating an actuator 46 on the pointing device 200 (step 660). In response to a selection by the user, the pointing device 200 sends a command signal to the appliance instructing the appliance to perform the desired function (step 670). The operation may then be repeated until an end condition, such as the deactivation of the pointing device 200, is encountered (step 680).

Figure 7:
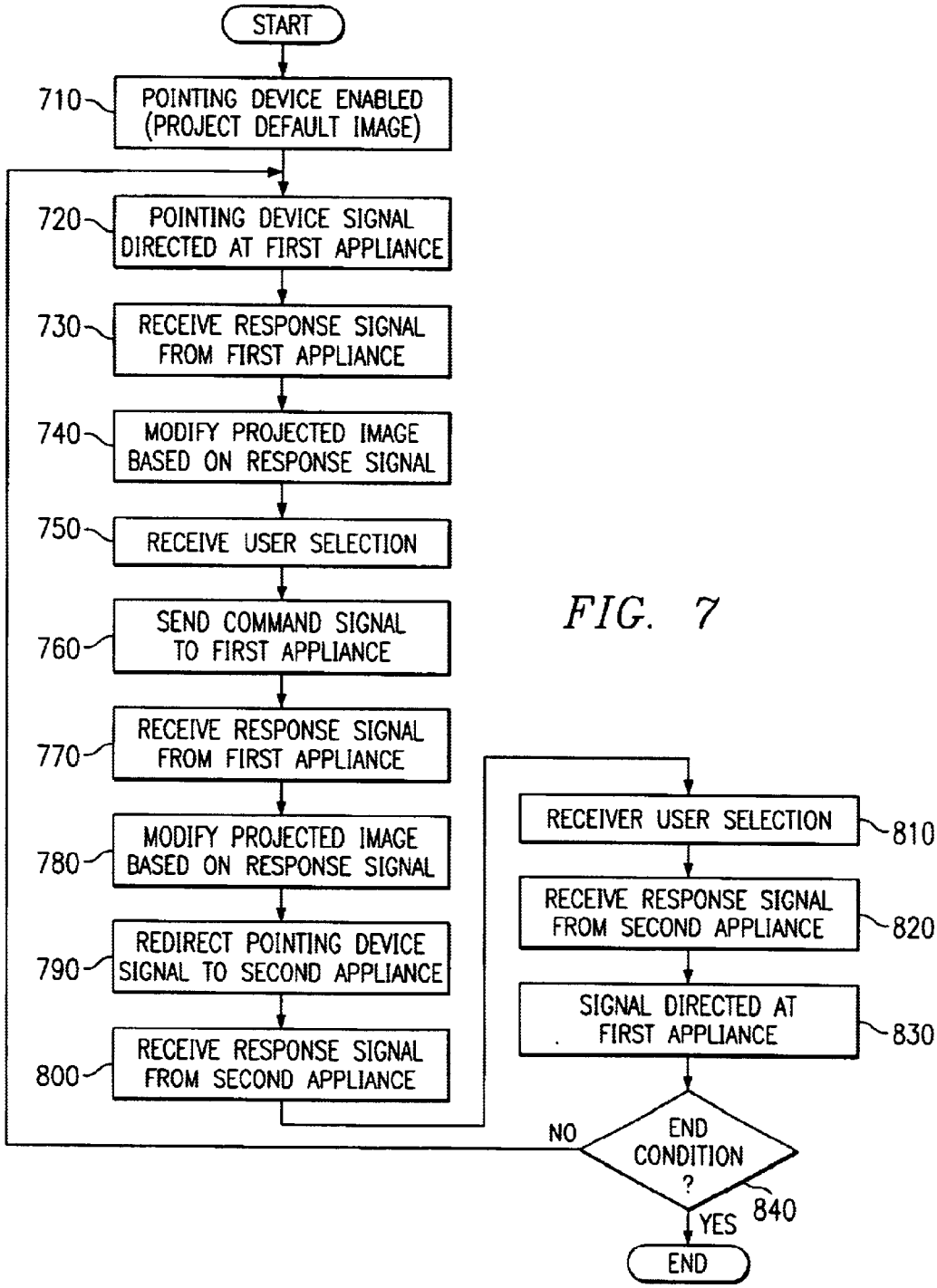
FIG. 7 is a flowchart outlining another exemplary operation of the hand held pointing device.

FIG. 7 is a flowchart outlining an exemplary operation of the pointing device 200 when communicating with a plurality of appliances. As shown in FIG. 7, the operation begins with the user enabling the pointing device 200 (step 710). When the pointing device 200 is enabled, a default image projection, such as an arrow image, may be projected so that the user is able to track where the pointing device 200 is being directed.

Then, the user directs the pointing device towards a first appliance thereby projecting the default image onto the first appliance and directing a signal to the first appliance (step 720). The first appliance sends a response signal to the pointing device 200 indicating the type of appliance and/or the available appliance functions that may be performed (step 730). These functions may include, for example, the selection of the first appliance, or the selection of resources associated with the first appliance.

In response to receiving the response signal from the first appliance, the pointing device 200 may modify the projected image to project one or more images corresponding to available appliance functions (step 740). For example, a selection image may be in the form of an open hand image.

The user may then select a desired function to be performed using the first appliance (step 750). When the user selects a function corresponding to a selection function for selecting either the first appliance or a resource associated with the first appliance, the pointing device 200 sends a command signal to the first appliance indicating that the selection function is desired (step 760). The first appliance sends a response signal indicating the identity of the selected appliance and/or resource (step 770). The pointing device 200 may then modify the projected image to indicate the selection (step 780).

The user then redirects the pointing device 200 to a second appliance and sends a signal to the second appliance (step 790). The signal sent to the second appliance may include the identifier of the selected appliance and/or resource. The second appliance sends a response signal to the pointing device 200 indicating what functions may be performed on the selected appliance and/or resource using the second appliance (step 800). The user may cycle through these available functions and select a desired function to be performed and thereby send a selection signal to the second appliance (step 810).

In response to the selection from the pointing device 200, the second appliance may respond with a second appliance and/or function identifier, such as a network address, which is then stored in the memory of the pointing device 200 (step 820). The pointing device 200 then sends a signal to the first appliance indicating the selected appliance and/or resource and the selected second appliance and/or function (step 830). The first and second appliances then work together to perform the selected function on the selected appliance/resource. The operation may then be repeated until an end condition is encountered (step 840).

It is important to note that while the present invention has been described in the context of a fully functioning data processing system, those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media such a floppy disc, a hard disk drive, a RAM, and CD-ROMs and transmission-type media such as digital and analog communications links.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A hand-held pointing device comprising:

a processor;

a transmitter coupled to the processor;

a receiver coupled to the processor;

a memory coupled to the processor, wherein the transmitter sends a signal to a remote device and the receiver receives a response signal from the remote device in response to receiving the signal from the transmitter, the response signal including remote device information identifying the remote device and available functions that may be performed by the remote device, and wherein the processor stores the remote device information in the memory;

a light projection apparatus that projects light from the hand-held pointing device; and a light projection modification apparatus coupled to the processor and the light projection apparatus, wherein the processor identifies projection information to be projected by the hand-held pointing device and instructs the light projection modification apparatus to modify the light projected from the light projection apparatus to project the projection information.

2. The hand-held pointing device of claim 1, wherein the processor identifies a projection information to be projected based on the response signal received from the remote device.

3. The hand-held pointing device of claim 2, further comprising at least one user operated actuator, wherein the processor identifies projection information to be projected based on user input to the at least one user operated actuator.

4. The hand-held pointing device of claim 1, wherein the light projection apparatus is a laser and the light projection modification apparatus is a laser deflection apparatus.

5. The hand-held pointing device of claim 1, wherein the light projection modification apparatus comprises:

a reflective surface coupled to an X-axis strut and a Y-axis strut, the X-axis strut being used to move the reflective surface in an X-axis direction and the Y-axis strut being used to move the reflective surface in a Y-axis direction;

an X-axis strut deflection device coupled to the X-axis strut for causing the X-axis strut to deflect; and a Y-axis strut deflection device coupled to the Y-axis strut for causing the Y-axis strut to deflect.

6. The hand-held pointing device of claim 5, wherein the X-axis strut deflection device and the Y-axis strut deflection device are speakers.

7. The hand-held pointing device of claim 5, wherein the X-axis strut deflection device and the Y-axis strut deflection device are voice coil motors.

8. The hand-held pointing device of claim 1, wherein the memory stores the projection information that is used by the processor to instruct the light projection modification apparatus to project the projection information.

9. The hand-held pointing device of claim 1, wherein the projection information represents a remote device function.

10. The hand-held pointing device of claim 1, wherein the projection information is an image.

11. A method of storing information in a hand-held pointing device, comprising:

sending a signal to a remote device;

receiving a response signal from the remote device in response to receiving the signal the response signal including remote device information identifying the remote device and available functions that may be performed by the remote device; and storing the remote device information in a memory, wherein the remote device information includes information identifying images to be projected by the hand-held pointing device, the images corresponding to the available functions that may be performed by the remote device.

12. A hand-held pointing device, comprising:

a processor;

a light projection apparatus that projects light from the hand-held pointing device; and a light projection modification apparatus coupled to the processor and the light projection apparatus, wherein the processor identifies an image to be projected by the hand-held pointing device and instructs the light projection modification apparatus to modify the light projected from the light projection apparatus to project the identified image.

13. The hand-held pointing device of claim 12, further comprising:

a transmitter coupled to the processor; and a receiver coupled to the processor, wherein the transmitter transmits signals to a target device and the receiver receives signals from the target device.

14. The hand-held pointing device of claim 13, wherein the processor identifies an image to be projected based on signals received from the target device.

15. The hand-held pointing device of claim 12, further comprising at least one user operated actuator.

16. The hand-held pointing device of claim 15, wherein the processor identifies an image to be projected based on user input to the at least one user operated actuator.

17. The hand-held pointing device of claim 13, wherein the signals received from the target device are received in response to the target device receiving the signals transmitted to the target device by the transmitter.

18. The hand-held pointing device of claim 13, wherein the signals received from the target device identify at least one of a target device type and target device functions.

19. The hand-held pointing device of claim 18, wherein the processor determines target device functions from a look-up table stored in a memory, based on the target device type.

20. The hand-held pointing device of claim 12, wherein the light projection apparatus is a laser and the light projection modification apparatus is a laser deflection apparatus.

21. The hand-held pointing device of claim 12, wherein the light projection modification apparatus comprises:

a reflective surface coupled to an X-axis strut and a Y-axis strut, the X-axis strut being used to move the reflective surface in an X-axis direction and the Y-axis strut being used to move the reflective surface in a Y-axis direction;

an X-axis strut deflection device coupled to the X-axis strut for causing the X-axis strut to deflect; and a Y-axis strut deflection device coupled to the Y-axis strut for causing the Y-axis strut to deflect.

22. The hand-held pointing device of claim 21, wherein the X-axis strut deflection device and the Y-axis strut deflection device are speakers.

23. The hand-held pointing device of claim 21, wherein the X-axis strut deflection device and the Y-axis strut deflection device are voice coil motors.

24. The band-held pointing device of claim 12, further comprising a memory that stores image patterns, wherein the image patterns are used by the processor to instruct the light projection modification apparatus to project the identified image.

25. The hand-held pointing device of claim 14, wherein the identified image represents a target device function.

26. The hand-held pointing device of claim 12, wherein the identified image represents a first target device function of a first target device when the identified image is projected on the first target device and wherein the identified image represents a second target device fraction that is to be performed in conjunction with the first target device function when the identified image is subsequently projected onto a second target device.

27. The hand-held pointing device of claim 13, wherein the signals transmitted to the target device and the signals received from the target device are at least one of optical signals and radio frequency signals.

28. The hand-held pointing device of claim 15, wherein when the user operated actuator is actuated, a target device function associated with the identified image is selected.

29. The hand-held pointing device of claim 15, wherein when the user operated actuator is actuated, the processor identifies a new image to be projected and instructs the light projection modification apparatus to modify the light projected from the hand-held pointing device to project the new image.

30. The hand-held pointing device of claim 29, wherein the identified image and the new image are images that are specific to a target device type.

31. The hand-herd pointing device of claim 12, wherein the identified image is an image identifying a currently available target device function that may currently be performed by a target device at which the hand-held pointing device is pointed.

32. A system for dynamic visual feedback using a hand-held pointing device, the system comprising:

a hand-held pointing device;

at least one target device; and at least one target device interface coupled to the at least one target device, wherein the hand-held pointing device receives a signal from the target device interface identifying the target device, and wherein the hand-held pointing device projects an image corresponding to the target device.

33. The system of claim 32, wherein the image identifies a currently available function that may be performed by the target device.

34. The system of claim 32, wherein the hand-held pointing device includes at least one user operated actuator, and wherein the hand-held pointer projects an image based on the operation of the at least one user operated actuator.

35. The system of claim 32, wherein the signal received from the target device interface is received in response to the target device interface receiving a signal transmitted by the hand-held pointing device.

36. The system of claim 32, wherein the signal received from the target device interface identifies at least one of a target device type and target device functions.

37. The system of claim 36, wherein the hand-held pointing device determines target device functions from a look-up table stored in a memory, based on the target device type.

38. The system of claim 32, wherein the hand held pointing device includes a laser and a laser deflection apparatus.

39. The system of claim 38, wherein the laser deflection apparatus comprises:

a reflective surface coupled to an X-axis strut and a Y-axis strut, the X-axis strut being used to move the reflective surface in an X-axis direction and the Y-axis strut being used to move the reflective surface in a Y-axis direction;

an X-axis strut deflection device coupled to the X-axis strut for causing the X-axis strut to deflect; and a Y-axis strut deflection device coupled to the Y-axis strut for causing the Y-axis strut to deflect.

40. The system of claim 39, wherein the X-axis strut deflection device and the Y-axis strut deflection device are speakers.

41. The system of claim 39, wherein the X-axis strut deflection device and the Y-axis strut deflection device are voice coil motors.

42. The system of claim 32, wherein the hand-held pointing device further comprising a memory that stores image patterns, and wherein the image patterns are used to create an image that is projected by the hand-held pointing device.

43. The system of claim 32, wherein the target device is a first target device, the system further comprising a second target device, wherein the hand-held pointing device projects a first image when the hand-held pointing device is pointed at the first target device and projects a second image when the hand-held pointing device is pointed at the second target device.

44. The system of claim 43, wherein the first image identifies a resource of the first target device and the second image identifies a function that may be performed by the second target device on the resource of the first target device.

45. The system of claim 35, wherein the signals transmitted to the target device interface and the signals received from the target device interface are at least one of optical signals and radio frequency signals.

46. The system of claim 34, wherein when the user operated actuator is actuated, a target device function associated with the projected image is selected.

47. The system of claim 34, wherein when the user operated actuator is actuated, the hand-held pointing device projects a new image.

48. The system of claim 47, wherein the projected image and the new image are images that are specific to a target device type.

49. A method of providing visual feedback using a hand-held pointing device, comprising:

receiving, at the hand-held pointing device, a signal from a target device; and projecting an image from the hand-held pointing device, the image corresponding to the signal received from the target device.

50. The method of claim 49, further comprising receiving a user command from an actuator on the hand-held pointing device, wherein the image is projected based on the user command.

51. The method of claim 49, wherein the signal received from the target device identifies at least one of a target device type and target device functions.

52. The method of claim 51, wherein the hand-held pointing device determines target device functions from a look-up table stored in a memory, based on the target device type.

53. The method of claim 49, wherein projecting an image from the hand-held pointing device comprises projecting light through a light projection modification apparatus, wherein the light projection modification apparatus modifies the image projected by the light.

54. The method of claim 53, wherein the light projection modification apparatus comprises a reflective surface coupled to an X-axis strut and a Y-axis strut, and wherein projecting an image from the hand-held pointing device further comprises at least one of deflecting the X-axis strut to move the reflective surface in an X-axis direction and deflecting the Y-axis strut to move the reflective surface in a Y-axis direction.

55. The method of claim 54, wherein deflecting the X-axis strut and deflecting the Y-axis strut comprises sending a signal to an X-axis strut deflection device coupled to the X-axis strut for causing the X-axis strut to deflect and sending a signal to a Y-axis strut deflection device coupled to the Y-axis strut for causing the Y-axis strut to deflect.

56. A method of remotely operating a target device using a hand-held pointing device, comprising:

sending a request signal from the hand-held pointing device to the target device;

receiving, at the hand-held pointing device, a response signal from the target device;

projecting an image from the hand-held pointing device, the image corresponding to the response signal; and selecting an operation associated with the projected image, the operation to be performed by the target device.

* * * * *

UNITED STATES PATENT AND TRADEMARK OFFICE

CERTIFICATE OF CORRECTION

PATENT NO. : 6,717,528 B1
DATED : April 6, 2004
INVENTOR(S) : Burleson et al.

It is certified that error appears in the above-identified patent and that said Letters Patent is hereby corrected as shown below:

Column 8,
Line 23, after "their website" delete "[www.ti.com/dlp/technolony]".

Column 14,
Line 13, after "the signal" insert -- , -- (comma).

Column 15,
Line 14, delete "band-held" and insert -- hand-held --.
Line 25, after "target device", delete "fraction" and insert -- function --.
Line 45, delete "hand-herd" and insert -- hand-held --.

Signed and Sealed this

Thirteenth Day of September, 2005

JON W. DUDAS
*Director of the United States Patent and Trademark Office*